US005588154A

United States Patent [19]

Blauer et al.

[11] Patent Number: 5,588,154

[45] Date of Patent: Dec. 31, 1996

[54] UNIFORM WITH OPTIONALLY CONCEALED/DEPLOYED VISUAL PANELS FOR DISPLAY ABOUT A 360 DEGREE PERIPHERY

[75] Inventors: Stephen Blauer, Lexington, Mass.; Mark Mordechai, Hampton, N.H.

[73] Assignee: Blauer Manufacturing Co. Inc., Boston, Mass.

[21] Appl. No.: 319,876

[22] Filed: Oct. 7, 1994

[51] Int. Cl.[6] ..... A41B 1/00

[52] U.S. Cl. ..... 2/69; 2/227; 2/115; 2/247

[58] Field of Search ..... 2/69, 1, 74, 75, 2/79, 80, 94, 105, 106, 108, 115, 121, 122, 227, 228, 238, 244, 246, 247, 249, 250, 251; 40/586

[56] References Cited

U.S. PATENT DOCUMENTS

| | | | |
|---|---|---|---|
| 2,663,876 | 12/1953 | Miller et al. | 2/94 |
| 3,051,962 | 9/1962 | Lippman | 2/247 |
| 3,381,307 | 5/1968 | Shingler | 2/94 |
| 4,138,745 | 2/1979 | Greenspan | 2/247 |
| 4,875,237 | 10/1989 | Cohen | 2/115 |
| 4,969,214 | 11/1990 | Cohen | 2/115 |
| 5,159,718 | 11/1992 | Moyer | 2/94 |

*Primary Examiner*—C. D. Crowder
*Assistant Examiner*—Gloria Hale

[57] ABSTRACT

A uniform comprising a shirt and trousers. The shirt has a back body section and split front body sections which cooperate with a yoke that extends across the shoulders from arm to arm and over the shoulders and about the collar between the back body section and front body sections. The front body sections have breast pockets, the tops of which are open and overlapped by free edges of the yoke. An inverted pocket at the back section has a bottom opening defined between the back body section and a free edge of the yoke. Display panels are detachably secured within the shirt pockets such that they can be concealed in or extended from the pockets. The trousers have a pair of side patch pockets. Display panels are detachably secured within the patch pockets such that they can be concealed in or extended from the pockets. When the display panels of both the shirt and trousers are extended, they are available for viewing about a substantially 360-degree periphery. Optionally, the display panels are retroreflective. Optionally, the trousers have a removable, wind resistant lining.

35 Claims, 9 Drawing Sheets

UNIFORM WITH OPTIONALLY CONCEALED/DEPLOYED VISUAL PANELS FOR DISPLAY ABOUT A 360 DEGREE PERIPHERY

BACKGROUND OF THE INVENTION

1. Field of the Invention

The present invention relates to clothing and, more particularly, to uniforms for police, fire, security, industry, government and like professional services.

2. Background of the Invention

Uniforms, perhaps more than other clothing, require designs that emphasize a combination of function, comfort and style. Often in the past, these attributes have been in conflict. In particular, uniforms with coordinated shirt and trousers have had to strike a complex compromise among these attributes. A compromise, for example, has been critical when incorporating visual accessories that must be capable of display in any direction, but optionally may be concealed or inconspicuous. In one form, such a display may include retroreflective panels capable of glaring back toward a headlight source in any direction by night. In another form, such a display may include graphics such as alphanumeric or directional printed matter capable of being viewed by day or night. Difficulties have been encountered in resolving such conflicting requirements, particularly, in uniforms that are intended to be washable and wearable year round.

BRIEF DESCRIPTION OF THE INVENTION

The primary object of the present invention is to provide a well styled, washable uniform comprising matching shirt and trouser constructions which together include a readily concealed/deployed display system that is characterized by visual presentations in whole or in part throughout a 360 degree periphery about a wearer. This display system is designed for complementary interaction with the shirt and trousers as follows.

The shirt construction includes a yoke having selectively secured, selectively free lower edges. The yoke extends across the shoulders from arm to arm and over the shoulders and about the collar between the back and the split front. At the breasts of the split front are patch pockets, the tops of which are open and overlapped by free edges of the yoke. At the center of the back is an inverted pocket with a bottom opening that is defined between the back and a free edge of the yoke. Detachably secured within all three pockets are display panels that may be confined within the pockets out of sight, or extended outwardly from the pockets for viewing.

The trouser construction includes, in addition to slant side pockets in the riser, opposed patch pockets therebelow at the sides of the legs. The open tops of these pockets are overlapped by flaps. Detachably secured within these pockets are display panels that may be concealed within the pockets out of sight, or extended outwardly from the pockets for viewing.

The foregoing arrangement enables an extraordinary combination of function, comfort and style. The pocket for each display panel is provided with a pair of meshing microcatch connectors (meshing microhook/microloop connectors), (1) one of which detachably anchors an edge of the panel while it is flipped into or out of the pocket, and (2) the other of which keeps the pocket closed when the panel is retained therewithin. Typically, these connectors are of the type sold by Velcro under the trade designation VELCRO. Such connectors securely retain the panels for alternate daytime and nighttime use, but permit detachment of the panels from within the pockets when the uniform is to be washed or the panels are to be transferred to another uniform. Preferably, the shirt and trousers both are composed of a blended polyester-cotton fabric.

In a preferred embodiment, the panels are retroreflectors of the type sold by 3M under the trade designation SCOTCHLITE. Such retroreflectors are characterized by high index of refraction microscopic beads that reflect incident light back toward its source. When the panels are concealed within their pockets, the smooth continuum of the yoke and the neat shaping of the pockets provide a visual impression of uncluttered simplicity. Alternatively, when the front and back panels of the shirt, and the side panels of the trousers are deployed, a 360 degree retroreflective periphery about the wearer is provided. Detachably secured within the riser and the legs also is a liner having a riser and legs that are composed of a breathable, wind-proof fabric that adapts the trousers for service throughout a wide range of seasons and temperatures. The trouser lining, which is retained within the trouser shell by buttons for use during cold weather, is removable to permit the uniform to be used during hot weather and to be washed at will.

BRIEF DESCRIPTION OF THE DRAWINGS

For a fuller understanding of the nature and objects of the present invention, reference is made to the following specification, which is to be taken in connection with the accompanying drawings, wherein.

DETAILED DESCRIPTION OF THE PREFERRED EMBODIMENT

Figure 1:
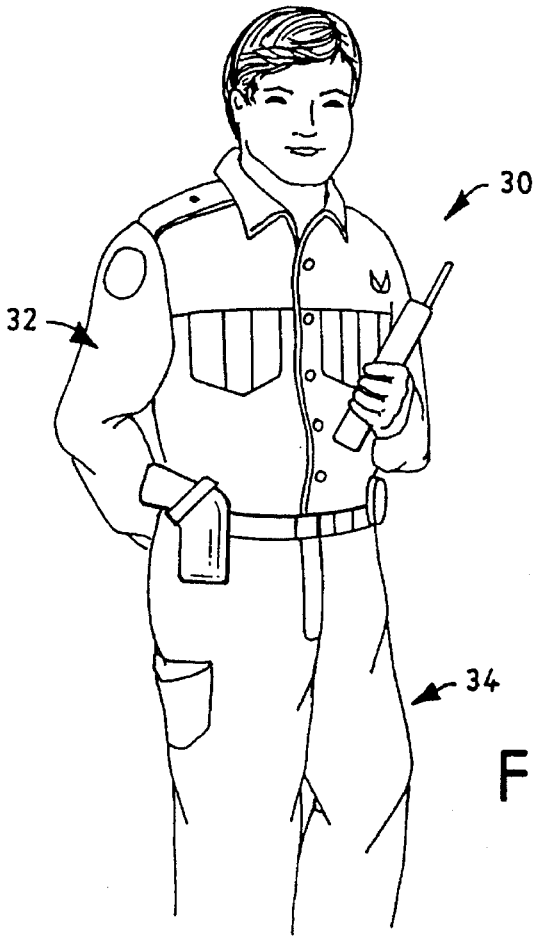
FIG. 1 is a perspective view of a uniform embodying the present invention, being worn with display panels concealed.
Figure 2:
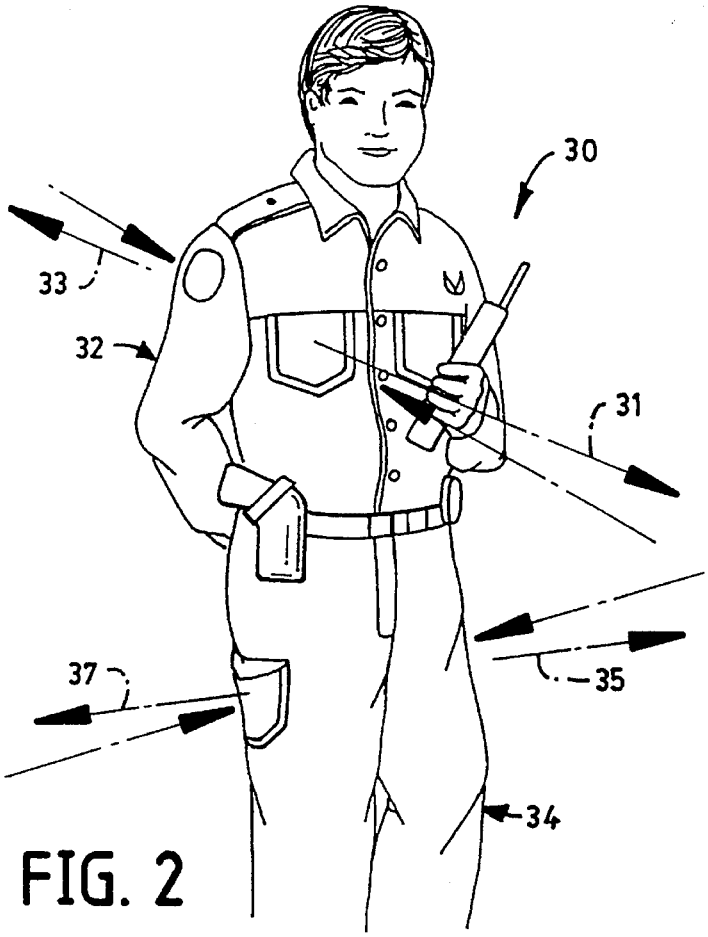
FIG. 2 is a perspective view, analogous to FIG. 1, of a uniform embodying the present invention, being worn with display panels deployed.

The Uniform of FIGS. 1 and 2

FIGS. 1 and 2 show a well styled, washable uniform 30 comprising matching shirt 32 and trouser 34 constructions, which together include a display system according to the present invention. In FIG. 1, display panels are concealed in pleated upright pockets at the front of the shirt and at the sides of the trousers, and in an inverted pocket at the back of the shirt. In FIG. 2, the panels are deployed from the pockets, thereby in effect presenting display surfaces throughout 360° about the vertical axis of the wearer's body, i.e. front panels at 31, a back panel at 33, and side panels at 35, 37. In one form, the panels reflect light diffusely. In another form, they reflect light specularly. In a preferred form, they reflect light retroreflectively.

In order to preserve the visual characteristics of the panels, it is well that they be removed from the shirt and trousers prior to washing. In order to enable year round use of the uniform, a removable wind-blocking but breathable liner 144 is provided for optional use with the trousers. The liner may be worn during cold weather, and removed during hot weather.

The Display Panel Structure of FIGS. 3–6

Figure 3:
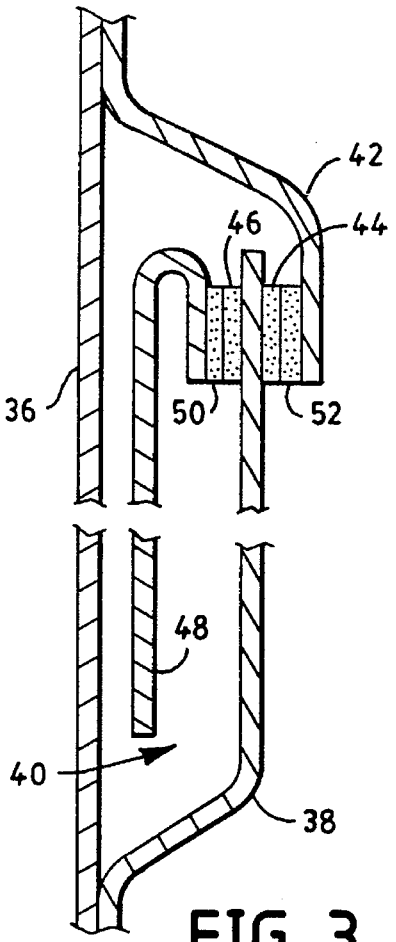
FIG. 3 is a fragmentary cross-sectional view, grossly exaggerated for clarity, of a patch pocket and display panel construction according to the present invention, with the panel concealed.
Figure 4:
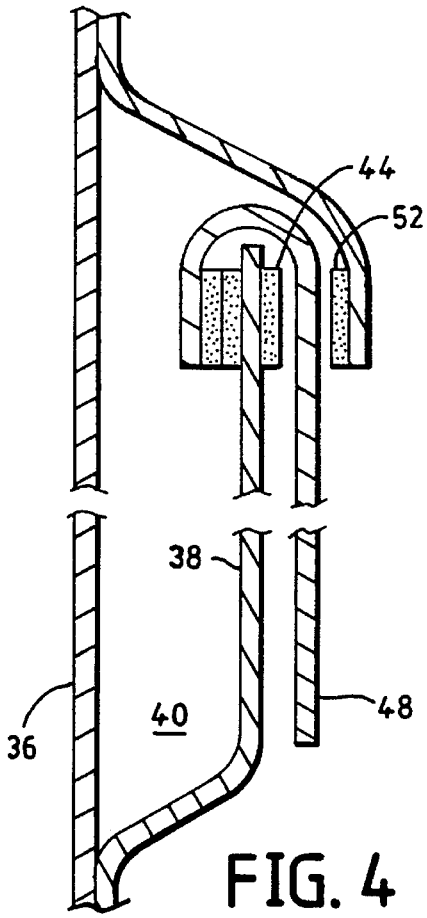
FIG. 4 is a fragmentary cross-sectional view, analogous to that of FIG. 3, with the panel deployed.

FIGS. 3 and 4 illustrate details of one of the structures by which the display panels associated with the front shirt and trouser pockets may be optionally concealed, deployed and removed. This structure includes a body section 36 and a patch section 38, which define a pocket 40, and a flap or yoke 42 that serves as a closure for the pocket. Within the pocket is a display panel 48. Permanently secured to the opposite faces at the free upper edge of patch section 38 are a pair of oppositely facing microcatch strips 44, 46. Permanently secured to one of the edges of panel 48 is a microcatch strip 50. Strip 50 and strip 46 are adapted to detachably mesh within pocket 40. Permanently secured at the inner face of the free edge of yoke or flap 42 is a microcatch strip 52. Strip 52 and strip 44 are adapted to detachably mesh outside of pocket 40.

As shown in FIG. 3, when panel 48 is reversely folded and retained within pocket 40, strips 44, 52 mesh to snugly close pocket 40 and to confine the panel securely therewithin. As shown in FIG. 4, when panel 48 is reversibly folded out of pocket 40 and draped over the front of patch section 38 between microcatch strips 44, 52, the panel is deployed to perform its display function. It is to be noted that microcatch strip 50 may be detached from microcatch strip 46 to permit removal of panel 48 from pocket 40 by which washing of the garment or transfer to another garment may be effected.

Figure 5:
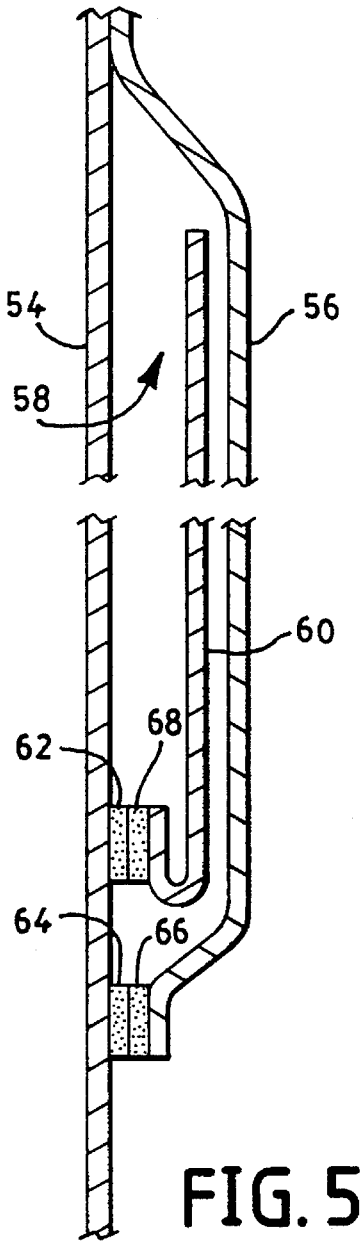
FIG. 5 is a fragmentary cross-sectional view, grossly exaggerated for clarity, of an inverted pocket and display panel construction according to the present invention, with the panel concealed.
Figure 6:
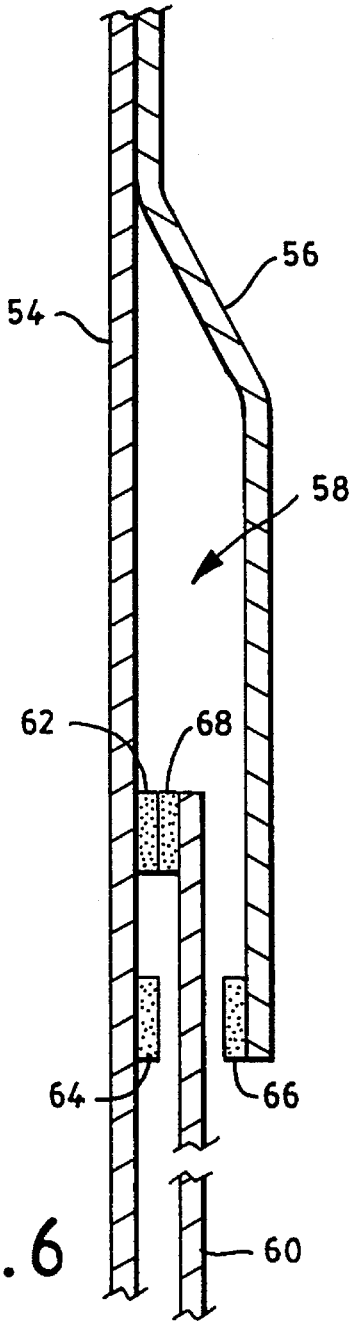
FIG. 6 is a fragmentary cross-sectional view, analogous to that of FIG. 5, with the panel deployed.

FIGS. 5 and 6 illustrate details of the structure by which the display panel associated with the inverted back pocket of the shirt may be optionally concealed, deployed and removed. This structure is shown as including the back section 54 of the shirt body and a yoke section 56, which define an inverted pocket 58. Within the pocket is a display panel 60. Permanently secured to the outer faces of back section 54 are upper and lower microcatch strips 62, 64. Permanently secured to the lower edge of yoke section 56 is a microcatch strip 66. Permanently secured to panel 60 is a microcatch strip 68. Strip 62 and strip 68 are adapted to detachably mesh within pocket 58. Strip 64 and strip 66 are adapted to detachably mesh at the lower edge of inverted pocket 58.

As shown in FIG. 5, when panel 60 is reversely folded and retained within pocket 58, strips 64, 66 mesh to snugly close pocket 58 and to confine the panel securely therewithin. As shown in FIG. 6, panel 60, when folded out of pocket 58 and draped over shirt back panel 54, hangs between microcatch strips 64, 66 and is deployed to perform its display display function. It is to be noted that microcatch strip 68 may be detached from microcatch strip 62 to permit removal of panel 60 from pocket 58, to permit washing of the garment or transfer of the panel to another garment.

The Long Sleeve Shirt of FIGS. 7–10

Figure 7:
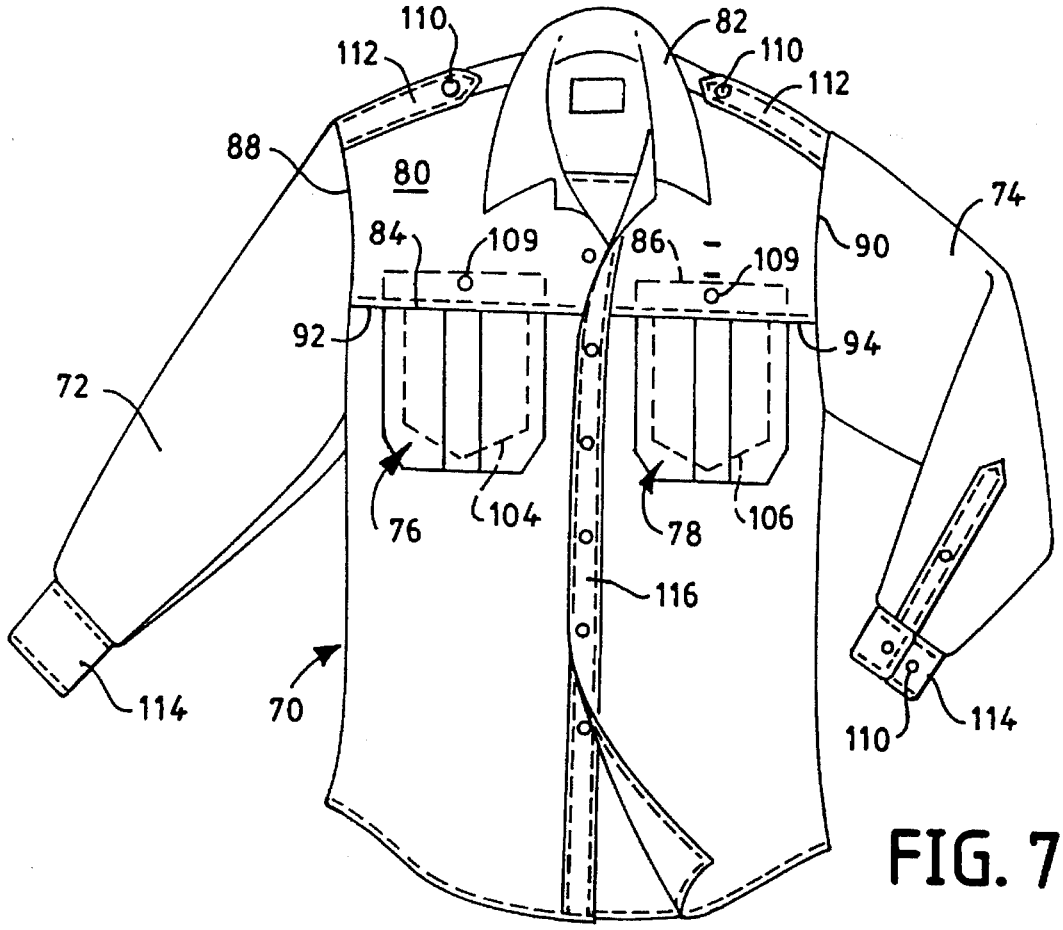
FIG. 7 is a front view of the panel-concealed mode of a long sleeve shirt of the present invention.
Figure 8:
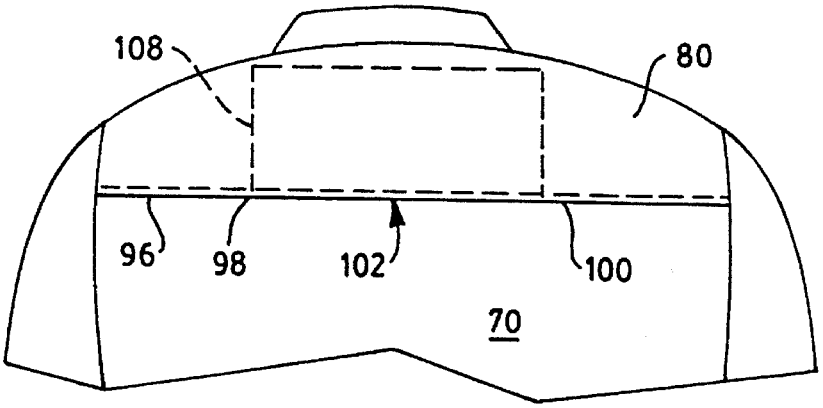
FIG. 8 is a fragmentary back view of the shirt of FIG. 7.

As shown in FIGS. 7 and 8, the shirt construction includes a body 70, arms 72, 74, pleated breast pockets 76, 78, a yoke 80, and a collar 82. Pockets 76, 78 are constructed from patches that are sewn to body 70 and are open at their top edges 84, 86. Yoke 80 extends across the shoulders from arm to arm and over the shoulders and about the collar between back and front. The side edgings of the yoke, the arm hole edgings of the body and the inner edging of the arms are joined by stitching along seams 88, 90. The lower front edgings 92, 94 of yoke 80 are free in the vicinity of breast pockets 76, 78, and slightly overlap the upper edges 84, 86 of the pockets. The lower rear edging 96 of the yoke is free between points 98, 100 so as to provide an inverted pocket 102 between the yoke and the body.

Figure 9:
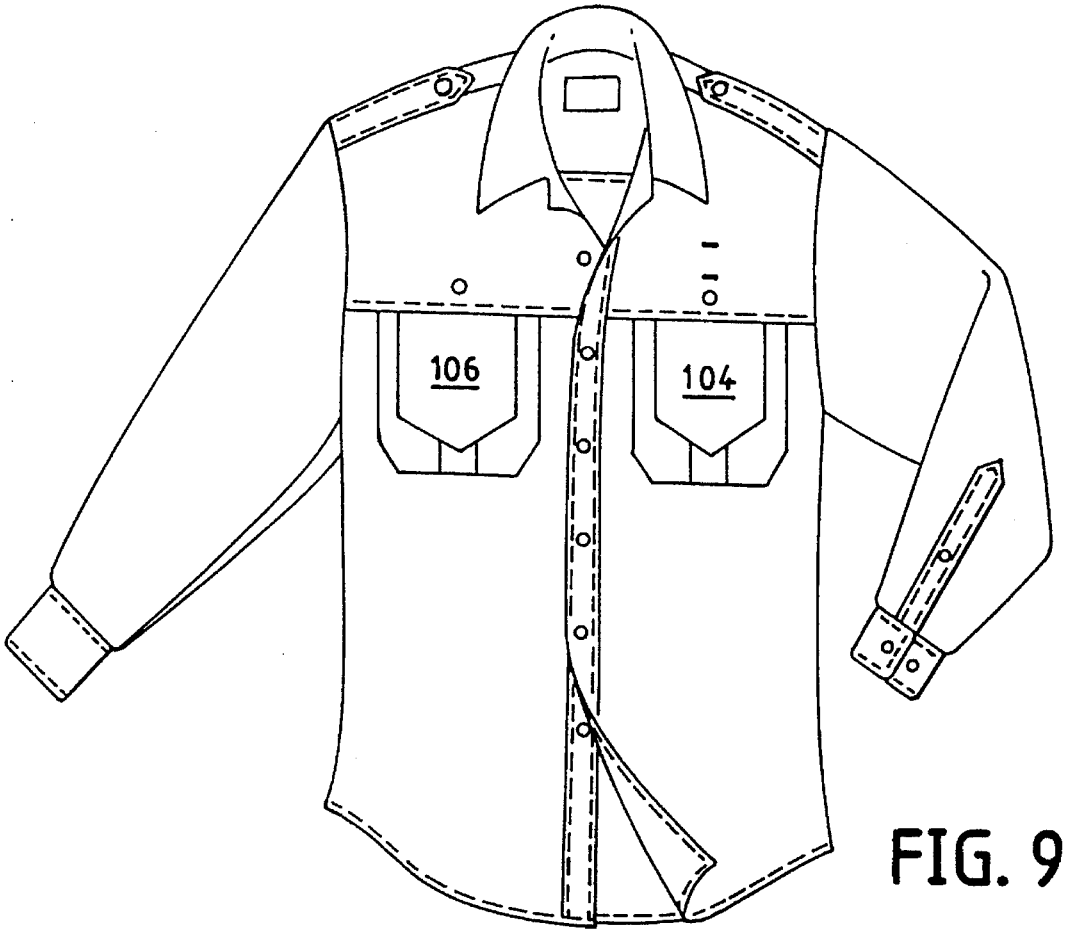
FIG. 9 is a front view of the panel-deployed mode of the shirt of FIG. 7.
Figure 10:
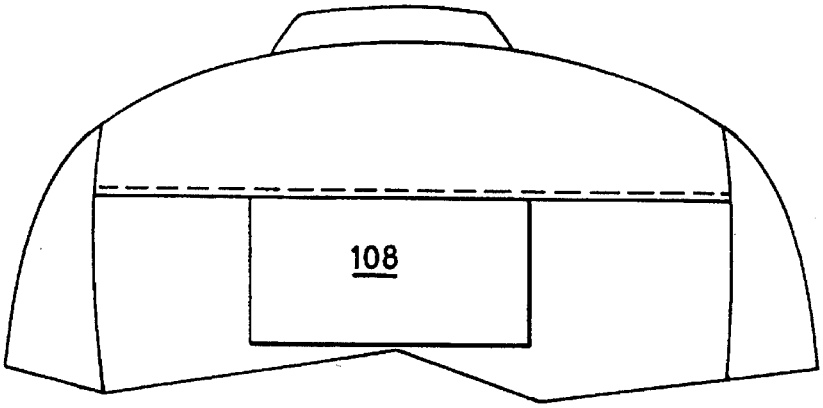
FIG. 10 is a fragmentary back view of the shirt of FIG. 9.
Figure 11:
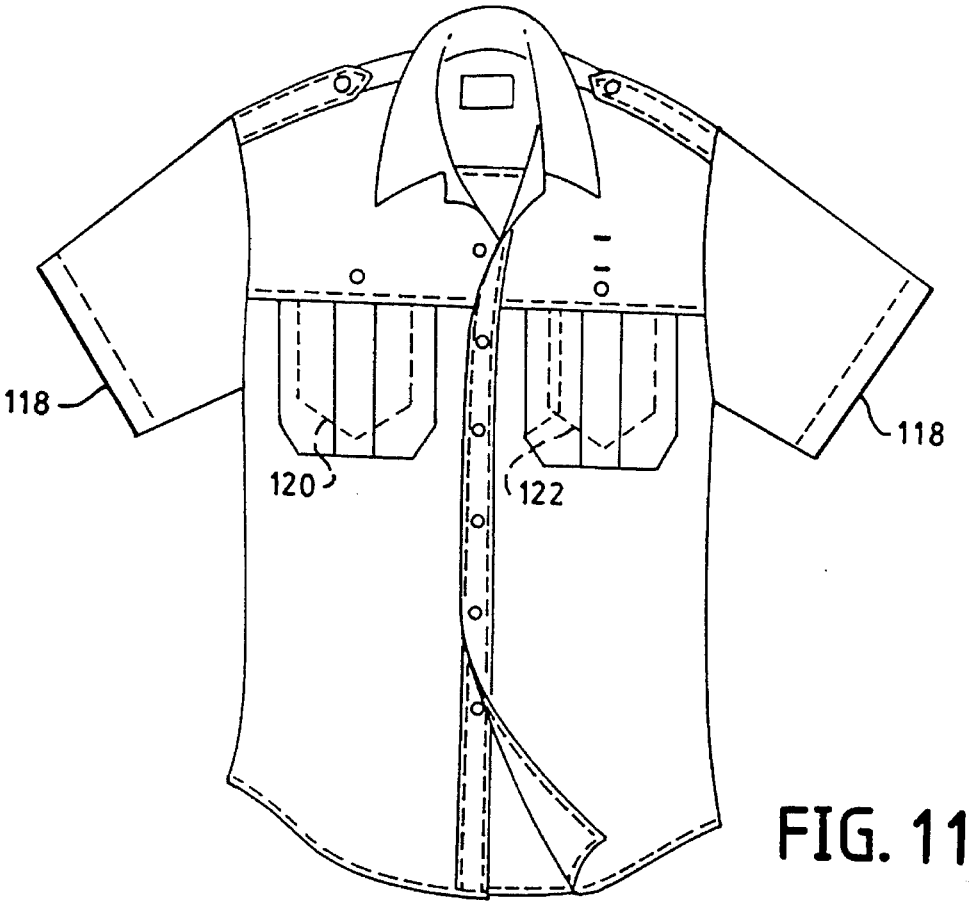
FIG. 11 is a front view of the panel-concealed mode of a short sleeve shirt of the present invention.
Figure 12:
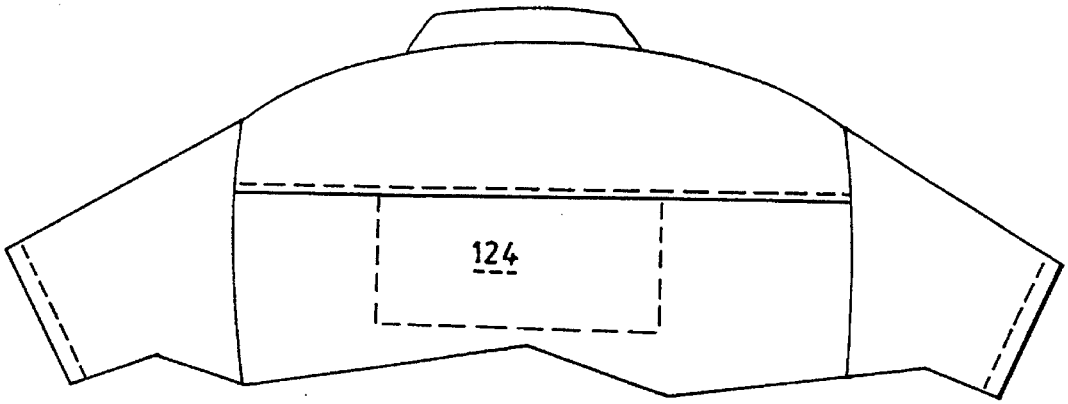
FIG. 12 is a fragmentary back view of the shirt of FIG. 11.
Figure 13:
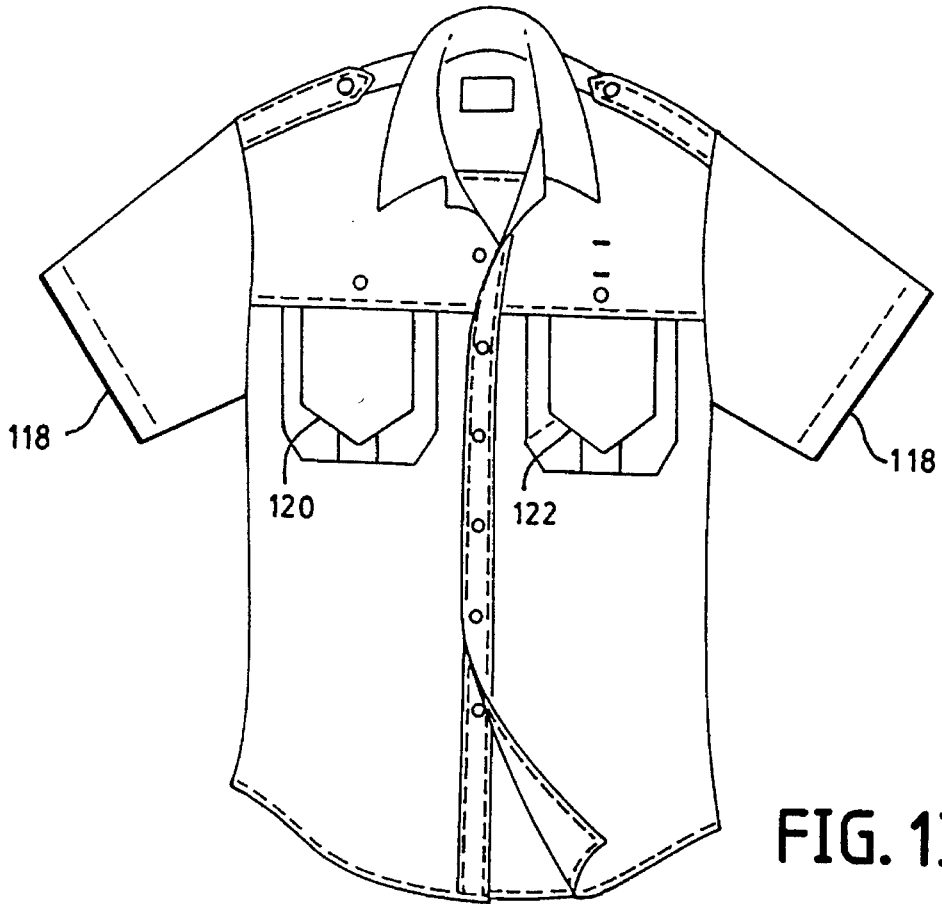
FIG. 13 is a front view of the panel-deployed mode of the shirt of FIG. 11.
Figure 14:
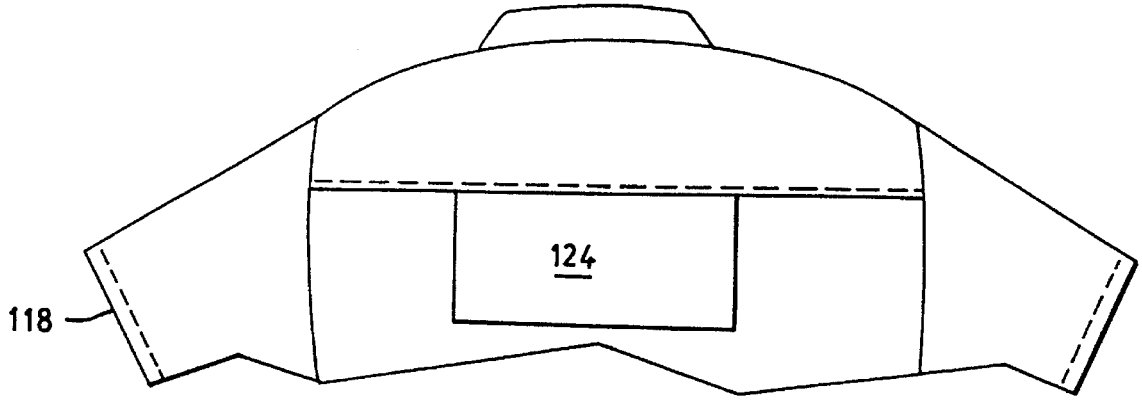
FIG. 14 is a fragmentary back view of the shirt of FIG. 13.

In FIGS. 7, 8, display panels 104, 106, 108 are shown as being concealed within pockets 76, 78, 102 and yoke 80 is shown as being closed, all in the manner shown in FIGS. 3 and 5. In FIGS. 9, 10, panels 104, 106, 108 are shown as being deployed, all in the manner shown in FIGS. 4 and 6. In both cases, mock buttons 109, matching stitching on epaulets 112 and cuffs 114, and matching buttons on epaulets 112, cuffs 114, and front strip 116, all contribute to an integrated aesthetic impact. Matching buttons 109 on the yoke in the vicinity of the pockets, although non-functional, contribute to this impact.

The Short Sleeve Shirt of FIGS. 11–14

The short sleeve version of the illustrated shirt as depicted in FIGS. 11–14 is analogous in almost all respects to the long sleeve version as depicted in FIGS. 7–10. The only significant change is the elimination of the cuffs and lower parts of the sleeves and their replacement by hems 118. display panels, which are shown at 120, 122, 124 operate in the manner previously described.

Figure 15:
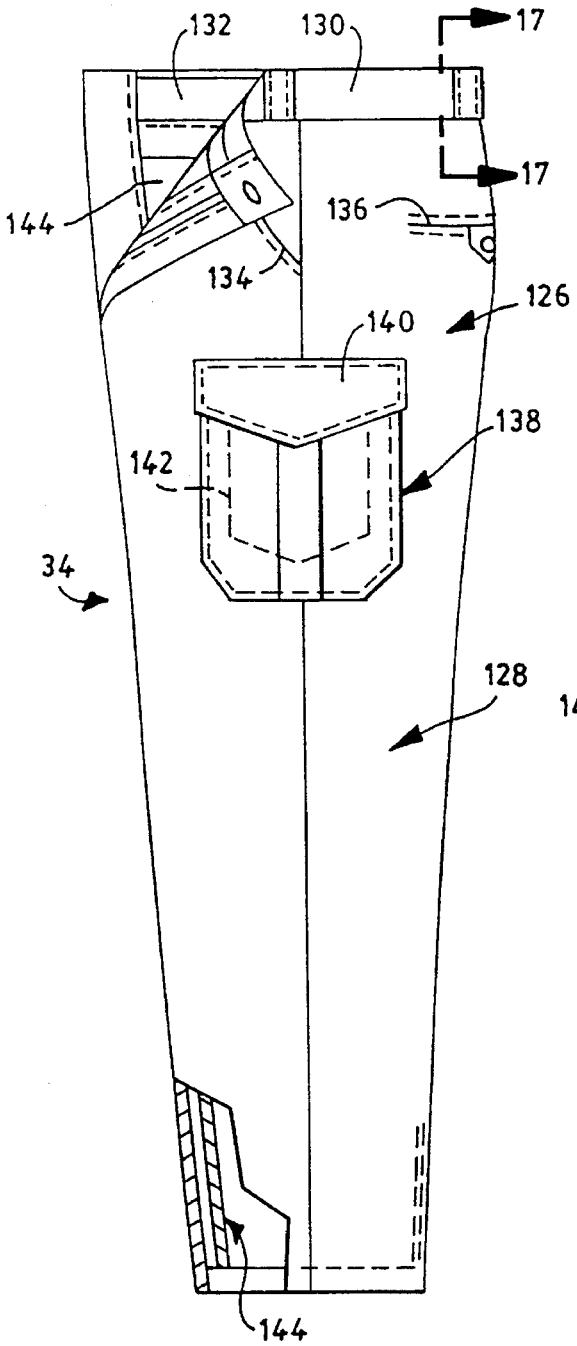
FIG. 15 is a side view of the panel-concealed mode of the trousers of FIG. 1.
Figure 16:
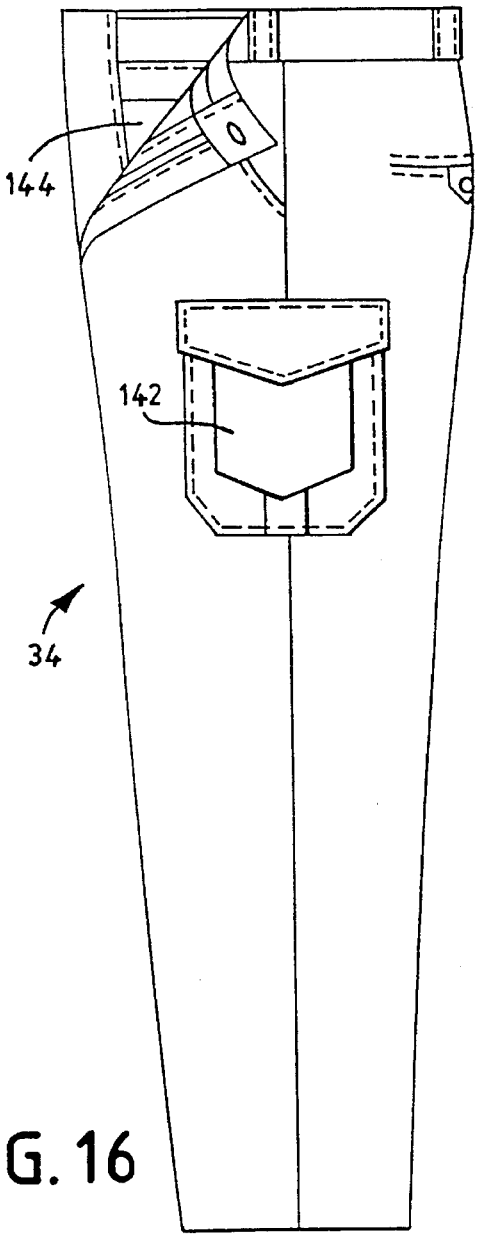
FIG. 16 is a side view of the panel-deployed mode of the trousers of FIG. 15.
Figure 17:
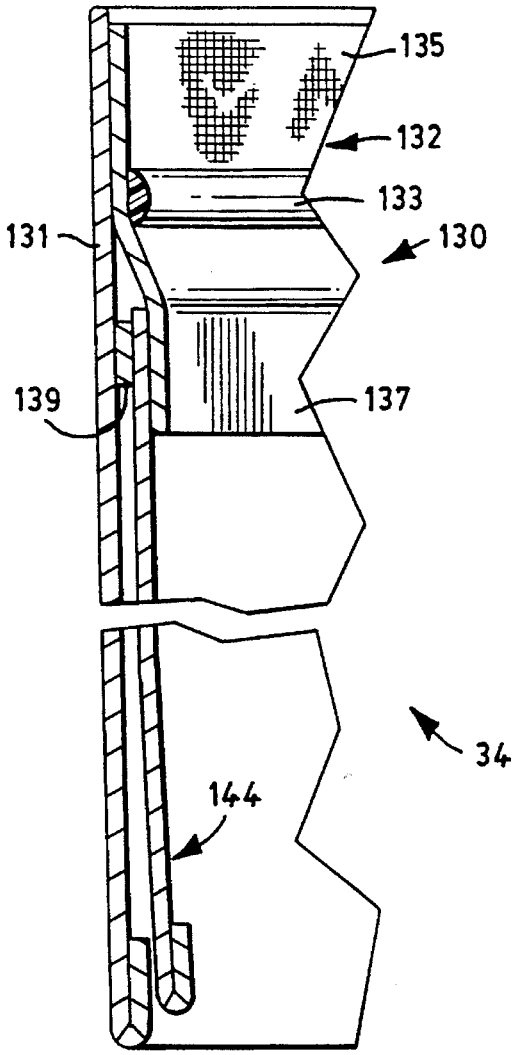
FIG. 17 is a broken away cross-section of the trousers of FIGS. 15,16, taken along the line 17, 17.
Figure 18:
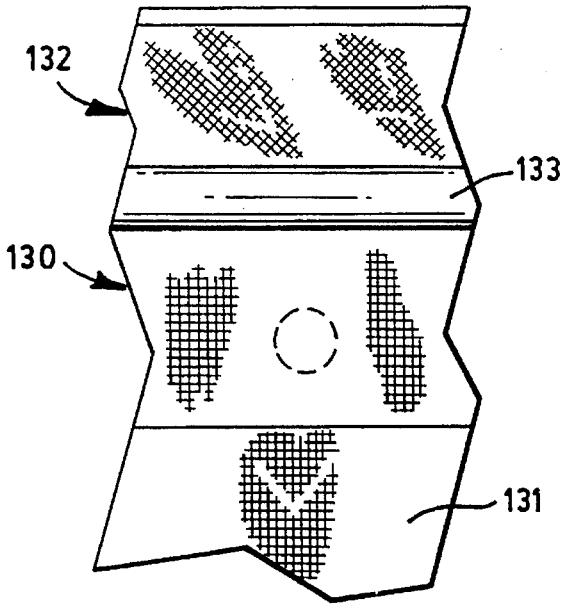
FIG. 18 is a broken away inner plan view of a part of the waist of the trousers of FIGS. 15, 16.

The Trousers of FIGS. 15, 16

Trousers 34 are shown as comprising a riser section 126 and a pair of legs, one of which is shown at 128. Riser 126 extends from a waist 130 to the crotch and seat regions. waist 130 includes an outer shell 131 an intermediate waist enveloping band 132, and an inner waist enveloping rib 133. Band 132 includes an upper waist-enveloping flank 135 and a lower waist-enveloping skirt 137. Flank 135, which is an elastomeric fabric, is sewn to the upper edge of shell 131. The outer face of skirt 137 carries spaced buttons, one of which is shown at 139. Rib 133 is an elastomeric bead having a non-slip or tacky surface. Riser 126 is provided with opposed slant pockets, one of which is shown at 134, and oppositely spaced back horizontal slit pockets, one of which is shown at 136. At opposed sides of the legs are opposed patch pockets, one of which is shown at 138. Each of pockets 138 is shown as being covered by a flap 140. Associated with each pocket is a display panel 142, the structure and function of which are shown and described in reference to FIGS. 3 and 4. The panel-concealed mode of trousers 34 is shown in FIG. 15. The panel-deployed mode of trousers 34 is shown in FIG. 16.

Shown in FIGS. 15 and 16, is a detachable lining 144, which is optionally retained or released by buttons 139. Lining 144, in one form, comprises, at its outer face, a membrane stratum and, at its inner face, a fabric stratum. Membrane stratum, in one form composed of a thin polymer, which, by virtue of its physico-chemical structure, i.e. its microstructure or molecular structure, is capable of resistance to wind, but of transmitting water vapor. In one form, membrane stratum is an expanded microporous polymer, i.e. a polymer which has been stretched to produce threre-through microscopic pores that are sufficiently large to permit the transmission of water vapor, but that are too small to permit the passage of droplets of liquid water. Droplets of liquid water have a sufficiently large surface tension to preclude deformation necessary for passage through the mircopores. In another form, membrane stratum is a hydrophilic polymer having molecular chains along which water vapor travels through the thermal gradient established between a relatively high temperature at the surface of a wearer and a relatively low temperature remote from the surface of the wearer. In still another form, the membrane stratum is simply a coating on lining fabric, the chemical composition of the coating corresponding to the chemical composition of the hydrophilic polymer discussed above.

The following non-limiting examples, further illustrate the structure and composition of the components of structures embodying the present invention.

EXAMPLE I

The shirts illustrated in FIGS. 7–10 have the following specifications:

SHELL FABRIC

The shell fabric of the long sleeve shirt is a machine washable and drycleanable cotton blend conforming to the following specifications in order to provide user comfort, uniform appearance, durability, easy care and low maintenance cost:

Cloth Type: 6.5 oz per square yard twill weave 65% polyester/35% cotton blend pre-cured for wrinkle resistance.

Count: Warp: 87 Filling: 52 (Numerical specifications below are average values and may vary plus or minus 10%)

Tensile Strength: Warp: 200 lbs Filling: 85 lbs (ASTM D 1682)

Tear Strength: Warp: 13.2 lbs Filling: 6.9 lbs (ASTM D 1424)

Shrinkage: Warp: 2.8% Filling: 1.7% (Washed 3 cycles at 120° F./125° F. Tumble Dry) (Appearance specifications are measured on a scale of 1–5 where 5=excellent)

Pilling: 3 (60 minutes ASTM D 3512)

Crocking: Dry: 3.5 Wet: 2 (AATCC 8)

Color: See specified garment color.

INTERLINING

For Epaulets:

Content: 100%

Weight: 4.0 oz. per square yard

Count: Warp: 50 Filling: 44

Shrinkage: 2% (maximum after 3 launderings)

For Pocket Flaps:

Content: 100% cotton

Weight: 2.3 oz. per square yard

Count: Warp: 56 Filling: 30

Shrinkage: 2% (maximum after 3 launderings)

For Collar and Cuffs:

Content: 100% cotton

Weight: 5.8 oz. per square yard

Count: Warp: 50 Filling: 40

Shrinkage: 2% (maximum after 3 launderings)

HOOK AND LOOP

The microcatch junctions are of the microhook, microloop type sold by Velcro corporation under the trademark VELCRO. This material is designed to meet specification MIL-F-21840 and shall match the shell fabric in color.

THREAD

Thread for safety stitch seams are polyester wrapped polyester core, vat dyed size #50 in the needles and size #70 in the loops. Thread for all other seams shall be size #50 polyester wrapped polyester core, vat dyed. Color shall match the shell fabric.

GENERAL DESIGN

The long-sleeve uniform shirt are a yoke front and back design with sport collar and center front placket. The epaulets, pleated patch pockets covered and secured by the front yokes, badge eyelets, 2-button adjustable cuffs, and self-lined yoke and collar, all contribute to the effectiveness of design. The pattern provides for extra long shirt tails. The back has two pleats at the shoulder and the back outside yoke is open.

SLEEVES

Sleeve ends have plackets furnishing 1¼ inches wide in the top placket and ½ inch wide under placket and have a single pleat attached to the cuffs. Cuffs finish 2¼ inches wide, are constructed of two plies of shell fabric plus one ply of the specified interlining, and are topstitched ¼ inch of the edges. Each cuff is 2-bottom adjustable with buttons set side by side ¾ inch apart on center. Sleeve setting and closing are sewn with an overedge safety stitch.

COLLAR

The collar is a sport collar style. The collar measures 3⅜ inches high in back when opened flat and is made of two plies of shell fabric plus one ply of the specified interlining. There is permanent collar stays sewn to the interlining so that no stitches are visible through the undercollar. The collar is topstitched around the edges and collar points are 3⅛ inches long. The collar closes with one button set to the top of the placket.

EPAULETS

The epaulets are die cut from shell fabric, creased and interlined with the specified interlining, and then folded and topstitched. The epaulets are sewn into the sleeve head seam, measure 1⅞ inches wide at the sleevehead and taper to 1½ inches wide with the end finishing in a point. The epaulets are set with the point approximately 1 inch from the collar seam. The epaulets are stitched to the shoulders with a row of stitching 2½ inches from the sleeve head and sewn diagonally from each end of the seam to the sleeve. There is an unslit buttonhole at the pointed end of the epaulet with the specified button sewn on top. The epaulets are then topstitched along both edges of the "V" forming the point to the shoulder of the shirt.

POCKETS

There are two breast pockets with pleated patch pockets and secured by the front yokes. The patch pocket measures 5¾ inches wide and 6¾ inches long with mitered corners and a 1½ inch box pleat stitched closed. There are a strip of loop fastener ⅝ inch by 3 inch sewn horizontally to the inside top edge of the patch pocket to secure the optional retroreflective material. The left pocket has a sewn pencil opening 1¼ inch wide. Microhook tape 1 inch wide by ½ inch high is sewn to the center top of each pocket to secure to the top yoke.

YOKES

There is a two ply back yoke with the inside ply sewn to the back and the outside ply open at the bottom edge overedge stitched, turned up inside 1 inch and ¼ inch topstitched and finished to overlap the inside ply seam by 1.2 inch. There are 5 pieces of micro-loop tape measuring 1 inch wide and ½ inch high sewn to the underside of the hem. There are 5 pieces of microhook tape measuring 1 inch wide and ½ inch set above the seam joining the inside ply to the back set to mate to the micro-loop tape set to the outside ply to close the yoke. There is a strip of micro-loop tape ⅝ inches wide and 9 inches long sewn above the microhook tape pieces to secure an optional removable Scotchlite reflective panel. The inside yoke measures approximately 3½ inch at the center and 3 inches at the sleeve head. The left and right front yokes are set into the sleeve head seams, front placket, collar, and shoulder seam with the bottom edges open. The bottoms are turned up inside 1 inch overedge stitched and ¼ inch topstitched to finish 1¼ inch over the pocket. There is a piece of micro-loop tape measuring 1 inch wide and ½ inch high sewn to the underside of the hem to mate to the microhook tape set to the pocket. There is an unslit buttonhole with a button stitched to the yoke ¾ inch up from the bottom of the yoke and centered over each pocket. There are two stitched eyelets sewn vertically 1¼ inch on center with the top eyelet set 3⅛ inches above the bottom of the yoke for badge attachment.

FRONTS

The left front has a mock center front placket measuring 1½ inches wide. The placket shows two rows of stitching ⅞ inch apart. Both right and left fronts have turned in facings measuring 3 inches wide and overage stitched. There are seven buttons and buttonholes set down the front.

STITCHING

All stitching is single needle at 10–12 stitches per inch except for (1) sleeving, closing, front placket joining seams, and back yoke seams which are safety stitched, and (2) concealed edges of front facings, outer yokes, and top of pockets are overedged.

EYELET HOLES

Eyelet holes are Reese eyelet hole type 3/16 inches in diameter.

BUTTONHOLES

Button holes are straight cut-after type.

OPTIONAL REMOVABLE SCOTCHLITE REFLECTIVE PACKAGE

In the retroreflective embodiment of the present invention the patch pockets and the back yoke are designed to accommodate optional removable retroreflective pull-downs that are sold by 3M under the trade designation Scotchlight #8930. These are hidden until deployed by the wearer for added visibility. The front pockets conceal tabs constructed on one ply of pocketing and one ply of silver Scotchlite #8930 and are straight across the top and pointed at the bottom. The tabs measure 3 inches wide and 6½ inches long. There is a strip of microhook fastener ⅝ inches by 3 inches sewn across the top edge of each tab to mate with the mircoloop fastener sewn inside each pocket. The back yoke conceals a panel measuring 4 inches high and 9 inches wide constructed of one ply of pocketing with a panel of silver Scotchlite #8930 measuring 2¼ inches high and 9 inches wide sewn to the bottom. The panel has a strip of microhook tape measuring ⅝ inch by 9 inches to the back side of the top of the panel to secure to the shirt.

EXAMPLE II

The trousers illustrated in FIGS. 15, 16 have the following specifications:

SHELL FABRIC

The shell fabric of the trousers is a machine washable and drycleanable cotton blend conforming to the following specifications in order to proved user comfort, uniform appearance, durability, ease care and low maintenance cost:

Cloth Type: 6.5 oz. per square yard twill weave 65% polyester/35% cotton blend pre-cured for wrinkle resistance.

Count: Warp: 87 Filling: 52 (Numerical specifications below are average values and may vary plus or minus 10%)

Tensile Strength: Warp: 200 lbs Filling: 85 lbs (ASTM D 1682)

Tear Strength: Warp: 13.2 lbs Filling: 6.9 lbs (ASTM D 1424)

Shrinkage: Warp: 2.8% Filling: 1.7% (Washed 3 cycles at 120° F./125° F. Tumble Dry) (Appearance specifications are measured on a scale of 1–5 where 5=excellent)

Pilling: 3 (60 minutes ASTM D 3512)

Crocking: Dry: 3.5 Wet: 2 (AATCC 8)

Color: See specified garment color.

INTERLINING

Cloth Type: 100% polyester non-woven

Weight: 2.5 oz. per square yard

Break Strength: Machine direction: 5 lbs per inch Across machine: 5.5 lbs per inch Color: Charcoal

BINDING

Binding is 100% polyester binding 1 inch in width.

Color: Black

POCKETING

Cloth Type: 5.5 oz. per square yard twill weave 65% polyester/35% cotton blend

Tensile Strength: Warp: 138 lbs Filling: 121 lbs (ASTM D 1682)

Tear Strength: Warp: 11.5 lbs Filling: 12.1 lbs (ASTM D 1424)

Shrinkage: Warp: 3.0% Filling: 2.5% (After 3 wash cycle)

Cleaning: Machine wash and dry or dry-clean

Color: Pearl grey

ZIPPER

The front fly zipper uses a delrin plastic size $4.5 with intermittent slider. Color is black.

WAISTBAND

The stretch waistband measures 3¼ inches wide and is composed of 83% polyester, 14% Spandex, and 3% nylon. There is an application or silicone rubber measuring 5/16 inches wide applied to the material to grip the shirt. The entire waistband material is machine washable, machine dryable, and drycleanable. Color: Grey

THREAD

Tread for all stitching except overedge stitching is size #50 polyester wrapped polyester core, vat dyed. Thread for overedge stitching is spun polyester size #70. Color matches the shell fabric.

GENERAL DESIGN

The uniform trousers are a tailored split-seam construction dress uniform style with two front quarter pockets, two double-section side pockets, two button-tab hip pockets, and wide waistband with belt loops inserted top and bottom. There is a wide elastic waistband with silicon shirt-grip stripe, permanent silicone adhesive crease on both the front and back of the legs, front crotch panels and fly lining with button tab. The patterning allows generous seat and thigh letout to accommodate alterations and athletic builds. The trousers are machine washable/dryable as well as drycleanable. The waistband construction and trouser patterning accommodate an optional removable windproof-breathable liner.

FRONT POCKETS

Front pockets are quarter pocket style with pockets slanting 1¾ inches from the top waistband to the bottom at the side seam. Pockets are constructed of one piece of the specified pocketing material finishing approximately 6½ inch wide at the bottom of the pocket opening and 12½ inches long from where the pocket is sewn into the waistband. There is a facing of shell fabric material running from the side seam and waistband and tapering to 2½ inches at the bottom of the pocket opening. There is a facing of shell fabric material on the inside of the pocket away from the body measuring 1¼ inches wide. There is a straight bartack across the top of the pocket opening ¼ inch down from the waistband and a triangular barrack across the bottom of the pocket opening centered on the side seam.

HIP POCKETS

Hip pockets are inverted double corded type with button tabs. Finished pocket opening measure 5⅛ inch and finished pocket depth is 6 inches. The finished pocket bag measures 6½ inches wide and extends down 9¼ inches from where it is sewn into the waistband. The button tabs are 7/16 inch wide looping constructed of two piles of shell fabric and one ply of fusible interlining. The tab finishes in a miter fold point with the ends set under to top corded welt of the pocket and extends 1¼ inches in length. There are two straight horizontal bartacks set top and bottom on the tab to define the button opening. There is a button set under the pocket to secure the hip pocket. The top and bottom pocket cord is topstitched. All facings are clean finished inside the pocket bag. There are triangular bartacks set at each end of the pocket opening.

SIDE POCKETS

There are double section side patch pockets sewn to each outside leg such that the pocket is centered vertically on the side seam of the trouser and the top of the pocket flap measures 3 inches below the bottom of the front quarter pocket. The pocket is constructed of two ply of fabric with the outside of the pocket constructed of shell fabric and the inside of the pocket constructed from the specified pocketing. The top edge of the pocket is bound with the specified binding. The outer pocket measures 8½ inches long and 7 inches wide and has a stitched-closed center pleat measuring 1½ inches wide. There is a strip of loop fastener ⅝ inch by 4 inch sewn horizontally to the inside top edge of the outer pocket to a retroreflective material sold by 3M under the trade designation Scotchlight. The pocket has mitered bottom corners. The pocket flap is made of two piles of shell fabric and one ply of interlining. The flap is pointed at the center and measures 7 inches sewn across the top to the inner pocket and down both sides covering the top edge of the outer pocket. The flap secures to the outer pocket with a piece of microhook tape measuring 1 inch high by 1½ inches wide sewn to the inner ply of the flap and a corresponding piece of pocket and to the trouser leg such that the zipper is recessed 1 inch from the top of the pocket flap. There is a straight vertical bartack on the top corners of each pocket flap.

WAISTBAND

The waistband finishes 2 inches wide and is constructed of one ply of shell fabric cut along the filling direction for maximum stretch of the specified waistband material. The finished waistband in the trouser stretches at least 1½ inches.

FLY

The right side of the fly is lined with a crotch reinforcement extension constructed of two piles of pocketing plus one ply of interlining and measuring 2 inches wide and extending down and clean finishing at the inseam. Inserted between the lining and the shell is a fly tab measuring 1½ inches wide and extending at an upward angle so that the tab extends 1¾ inches along the top edge and 2½ inches along the bottom edge. The tab finishes in a point with a buttonhole and the tab is topstitched around the edges. The left inside edge of the fly is bound with the specified binding. The left fly is J-stitched 1½ inch from the folded edge. The specified zipper is attached to the fly and the bottom of the fly opening is straight tacked.

CROTCH LINING

Crotch is lined in the front with 2 plies of the specified pocketing material bias cut with a folded edge.

BELT LOOPS

The belts loops are inserted into the waistband curtain at the top and drop loop inserted into the waistband at the bottom. Loops are 1 inch wide and constructed of two plies of shell fabric and one ply of interlining butted on the reverse side and sewn with a looping machine. There are a minimum of six belt loops per pair with larger sizes getting additional pairs as required. There is an additional belt loop provided loose in the hip pocket of each pair for use as needed in the event the seat is let out.

OUTLETS

The seat outlet measures 1½ inches on each side at the waistband tapering to ⅜ inches at the crotch. There are thigh outlets with the back side of the inseam measuring 1 inch at the crotch tapering to ⅜ inch at the knee.

STITCHING

All seams are sewn at 10–12 stitches per inch. Stitching on waistband, outseam, and inseam is single needle chainstitch. Stitching for seat seam is tandem needle chainstitch. Stitching for beltloops is double needle blindstitch. Overedge stitching for fronts and backs are 2 thread overedge stitch. All other seams are single needle lockstitch. Straight bartacks are 28 stitch count ⅜ inches long. Triangle bartacks are 124 stitch count ⅜ inches long on each side.

OPTIONAL REMOVABLE WINDPROOF-BREATHABLE LINER

The trousers are designed to accommodate an optional removable windproof-breathable liner which when installed provides additional winter weather protection. The liner is constructed from windproof-breathable material sold by Gore under the trade designation WIND STOPPER, laminated to a black brushed polyester tricot material with the brushed surface toward the body for comfort. There are buttonholes set in the top of the liner and buttons set to the underside of the trouser waistband to fasten the liner to the trouser. The liner is machine washable and dryable.

OPTIONAL REMOVABLE SCOTCHLITE REFLECTIVE PACKAGE

The side pockets of the trousers are designed to accommodate optional removable retroreflective tabs that are hidden inside the outer pocket until deployed by the wearer. The tabs are constructed of one ply of shell fabric and one ply of Scotchlite #8930 and are straight across the top and pointed at the bottom. The tab measures 4 inches wide and 6 inches long. There is a strip of microhook fastener ⅝ inches by 4 inches sewn across the top edge to mate with the microloop fastener sewn inside the pocket.

OPERATION

The operation of the illustrated uniform is as follows. The back body section and the right and left front body sections of the shirt, cooperate with the yoke which extends across the shoulders from arm to arm and over the shoulders and about the collar between the back body section and front body sections. The front body sections have breast pockets, the tops of which are open and overlapped by free edges of the yoke. An inverted pocket at the back section has a bottom opening defined between the back body section and a free edge of the yoke. Display panels tabs are detachably secured within the shirt pockets. These panels are adapted to be confined within the pockets out-of-sight or extended outwardly from the pockets for viewing. The trouser construction includes a riser having opposed slant, side pockets and opposed patch pockets under the slant pockets at the sides of the legs. Display panels tabs that are detachably secured within the trouser pockets optionally are adapted to be confined within the trouser patch pockets out-of-sight or extended outwardly from the pockets for viewing. When concealed, the panels are neatly retained in their pockets by microhook/microloop fasteners and the appearance uniform is not marred by unneeded display panels. Alternatively, the display panels of the shirt and the trousers are deployed to provide a 360° periphery for viewing. These panels can be readily removed from their pockets to permit laundering or transer to other like clothing. At the waist of the trousers is an elastomeric band and a non-slip rib, the band serving to snugly envelop the waist and to optionally support the trouser lining and the rib serving to restrain slippage between the trouser and the shirt. The lining of the trousers is optionally buttoned into the shell or removed from the shell to permit all season comfort.

What is claimed is:

1. A uniform for a human wearer, said uniform comprising matching shirt and trouser constructions:

(a) said shirt construction including a back body section, right and left front body sections, pairs of arms and sleeves, a collar, and a selectively secured, selectively free yoke that extends across said wearer's shoulders from arm to arm and over said shoulders and about said collar between said back body section and said front body sections;

(b) said front body sections having breast pockets, said breast pockets having tops that are open and overlapped by free edges of said yoke;

(c) an inverted pocket at said back body section, with a bottom opening defined between said back body section and a free edge of said yoke;

(d) shirt display panels detachably secured within said breast pockets and said inverted pocket, said shirt display panels being adapted to be confined within said breast pockets and said inverted pocket out of sight or extended outwardly from said breast pockets and said inverted pocket for viewing;

(e) said trouser construction including a riser, a pair of legs, slant side pockets in said riser and side patch pockets under said slant side pockets at the sides of said legs;

(f) trouser display panels detachably secured within said side patch pockets, said trouser display panels being adapted to be confined within said side patch pockets out of sight or extended outwardly from said side patch pockets for viewing; and (g) whereby, when all of said display panels of said breast pockets, said inverted pocket and said side patch pockets are deployed, the summation of said panels are available for viewing substantially throughout a 360-degree periphery about said wearer.

2. The uniform of claim 1 wherein said pocket for each display panel is provided with: (a) a detachable connector for securing an edge of said display panel while it is flipped into or out of said pocket, and (b) an outwardly located connector for keeping said pocket closed when said panel is retained therewithin.

3. The uniform of claim 2 wherein said connectors are in the form of detachable microhook/microloop patches, said connectors being adapted to securely retain said panel for alternate concealed and unconcealed use, and also to permit detachment of said panels from said pockets when said uniform is to be washed or said panels are to be transferred to another uniform.

4. The uniform of claim 1 wherein, when said panels are concealed within their associated pockets, the smooth continuum of said yoke and said pockets provide a visual impression of uncluttered simplicity.

5. The uniform of claim 1 wherein said shirt and trouser constructions are composed of a blended polyester-cotton fabric.

6. The uniform of claim 1 wherein said panels are retroreflective.

7. The uniform of claim 1 wherein said panels are diffusely reflective.

8. The uniform of claim 1 wherein said panels contain visual information.

9. A shirt construction for a human wearer, said shirt comprising:

(a) a back body section, right and left front body sections, pairs of arms and sleeves, a collar, and a yoke having selectively secured, selectively free lower edges, said yoke extending across said wearer's shoulders from arm to arm and over said shoulders and about said collar between said back body section and said front body sections;

(b) said front body sections having breast pockets, said breast pockets having tops that are open and overlapped by certain of said free edges of said yoke;

(c) an inverted pocket at said back body section, with a bottom opening defined between said back body section and a free edge of said yoke; and (d) display panels detachably secured within said pockets, said panels being adapted to be concealed within said pockets or to be extended outwardly from said pockets.

10. The shirt construction of claim 9 wherein said pocket for each display panel is provided with: (a) a detachable connector for securing an edge of said display panel while it is flipped into or out of said pocket, and (b) an outwardly located connector for keeping said pocket closed when said panel is retained therewithin.

11. The shirt construction of claim 10 wherein said connectors are in the form of detachable microhook/microloop patches, said connectors being adapted to securely retain said panel for alternate panel-concealed and panel-deployed use, and also to permit detachment of said panel from said pocket.

12. The shirt construction of claim 11 wherein, when said panels are concealed within their associated pockets, said associated pockets are closed by certain of said connectors.

13. The shirt construction of claim 12 wherein said shirt construction is composed primarily of a polyester-cotton blend.

14. A trouser construction comprising:

(a) a riser, a pair of legs, opposed slant side pockets in said riser, and opposed patch pockets under said side pockets at the sides of said legs;

(b) display panels detachably secured within said patch pockets, said panels being adapted to be concealed within said patch pockets out of sight or extended outwardly from said patch pockets for viewing; and (c) each display panel being provided with a detachable connector for securing an edge of said display panel while it is flipped into or out of said pocket and an outwardly located connector for keeping said pocket closed when said panel is retained therewithin.

15. The trouser construction of claim 14 wherein said connectors are in the form of detachable microhook/microloop patches, said connectors being adapted to securely retain said panel for alternate concealment and deployment of said panel from said pocket.

16. The trouser construction of claim 15 wherein, when said panels are concealed within their associated pockets, said associated pockets are closed by certain of said connectors.

17. The trouser construction of claim 14 wherein said trouser construction is composed primarily of a polyester-cotton blend.

18. A uniform for a human wearer, said uniform comprising matching shirt and trouser constructions:

(a) said shirt construction including a back body section, right and left front body sections, pairs of arms and sleeves, a collar, and a selectively secured, selectively free yoke that extends across said wearer's shoulders from arm to arm and over said shoulders and about said collar between said back body section and said front body sections;

(b) said front body sections having breast pockets, said breast pockets having tops that are open and overlapped by free edges of said yoke;

(c) an inverted pocket at said back body section, with a bottom opening defined between said back body section and a free edge of said yoke;

(d) shirt display panels detachably secured within said breast pockets and said inverted pocket, said shirt display panels being adapted to be concealed within said breast pockets and said inverted pocket out of sight or extended outwardly from said breast pockets and said inverted pocket for viewing;

(e) said trouser construction including a riser, a pair of legs, slant side pockets in said riser and side patch pockets under said slant side pockets at the sides of said legs;

(f) trouser display panels detachably secured within said side patch pockets, said trouser display panels being adapted to be concealed within said side patch pockets out of sight or extended outwardly from said side patch pockets for viewing;

(g) whereby, when said display panels of said breast pockets, said inverted pocket and said side patch pockets are deployed, said panels are available for viewing substantially throughout a 360-degree periphery about said wearer;

(h) each of said breast pockets and said side patch pockets being defined by a body section and a patch section, a pair of microcatch elements being affixed to opposed faces of said patch section and complementary microcatch elements being affixed to said panel and said body section associated therewith; and (i) said inverted pocket being defined by a body section and a yoke section, a pair of microcatch elements being affixed to the same face of said body section, and a pair of complementary microcatch elements being affixed to said panel and said yoke.

19. A shirt construction for a human wearer, said shirt comprising:

(a) a back body section, right and left front body sections, pairs of arms and sleeves, a collar, and a yoke having selectively secured, selectively free lower edges, said yoke extending across said wearer's shoulders from arm to arm and over said shoulders and about said collar between said back body section and said front body sections;

(b) said front body sections having breast pockets, said breast pockets having tops that are open and overlapped by certain of said free edges of said yoke;

(c) an inverted pocket at said back body section, with a bottom opening defined between said back body section and a free edge of said yoke;

(d) retroreflective panels detachably secured within said pockets, said panels being adapted to be concealed within said pockets or to be extended outwardly from said pockets;

(e) each of said breast pockets being defined by a body section and a patch section, a pair of microcatch elements being affixed to opposed faces of said patch section and complementary microcatch elements being affixed to said panel and the closure associated therewith; and (f) said inverted pocket being defined by a body section and a yoke section, a pair of microcatch elements being affixed to the same face of said body section, and a pair of complementary microcatch elements being affixed to said panel and said yoke.

20. The shirt construction of claim 19 wherein said panels contain visual graphics.

21. The shirt construction of claim 19 wherein said panels are diffusely reflective.

22. The shirt construction of claim 19 wherein said panels are specularly reflective.

23. The shirt construction of claim 19 wherein said panels are retroflective.

24. A trouser construction comprising:

(a) a riser, a pair of legs, opposed slant side pockets in said riser, and opposed patch pockets under said slant side pockets at the sides of said legs;

(b) retroreflective panels detachably secured within said patch pockets, said panels being adapted to be concealed within said patch pockets or extended outwardly from said patch pockets; and (c) each of said patch pockets being defined by a body section and a patch section, a pair of microcatch elements being affixed to opposed faces of said patch section and complementary microcatch elements being affixed to said panel and said body section associated therewith.

25. The trouser construction of claim 24 wherein said panels contain visual graphics.

26. The trouser construction of claim 24 wherein said panels are diffusely reflective.

27. The trouser construction of claim 24 wherein said panels are specularly reflective.

28. The trouser construction of claim 24 wherein said panels are retroflective.

29. A uniform for a human wearer, said uniform comprising matching shirt and trouser constructions:

(a) said shirt construction including a back body section, right and left front body sections, pairs of arms and sleeves, a collar, and a yoke having selectively secured, selectively free lower edges, said yoke extending across said wearer's shoulders from arm to arm and over said shoulders and about said collar between said back body section and said front body sections;

(b) said front body sections having breast pockets, said breast pockets having tops that are open and overlapped by free lower edges of said yoke;

(c) an inverted pocket at said back body section, with a bottom opening defined between said back body section and a free lower edge of said yoke;

(d) retroreflective shirt display panels detachably secured within said breast pockets and said inverted pocket, said shirt display panels being adapted to be concealed within said breast pockets and said inverted pocket or extended outwardly from said breast pockets and said inverted pocket;

(e) said trouser construction including a shell having a riser, a pair of legs, slant side pockets in said riser and side patch pockets under said slant side pockets at the sides of said legs;

(f) retroreflective trouser display panels detachably secured within said side patch pockets, said trouser display panels being adapted to be concealed within said side patch pockets or extended outwardly from said side patch pockets;

(g) each of said breast pockets and said side patch pockets being defined by a body section and a patch section, a pair of microcatch elements being affixed to opposed faces of said patch section and complementary microcatch elements associated therewith to secure each of said breast pockets and said side patch pockets;

(h) said inverted pocket being defined by a body section and a yoke section, a pair of microcatch elements being affixed to the same face of said body section, and complementary microcatch elements associated therewith to secure said inverted pocket;

(i) whereby when said breast pockets, said inverted pocket, and said side patch pockets are deployed, said display panels present retroreflectively substantially throughout a 360-degree periphery about said wearer;

(j) said trouser construction having a waist band and a rib enveloping said riser;

(k) said waist band having a stretchable flank sewn to said shell and a skirt;

(l) spaced buttons about said skirt between said skirt and said shell; and (m) a liner having button holes at the waist thereof for receiving said buttons.

30. A uniform for a human wearer, said uniform comprising matching shirt and trouser constructions:

(a) said shirt construction including a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke;

(d) shirt display panels adapted to be confined within said breast pockets and said inverted pocket out of sight or to be extended outwardly from said breast pockets and said inverted pocket for viewing, said shirt display panels being retroreflective;

(e) said trouser construction including a riser, a pair of legs, and side pockets at the sides of said legs;

(f) trouser display panels adapted to be confined within said side pockets out of sight or extended outwardly from said side pockets for viewing, said trouser display panels being retroreflective; and (g) whereby, when all of said display panels are deployed outside of said breast pockets, said inverted pocket and said side pockets, the summation of said display panels are available for viewing substantially throughout a 360-degree periphery about said wearer.

31. A uniform for a human wearer, said uniform comprising matching shirt and trouser constructions:

(a) said shirt construction including a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke;

(d) shirt display panels adapted to be confined within said breast pockets and said inverted pocket out of sight or to be extended outwardly from said breast pockets and said inverted pocket for viewing, said shirt display panels being diffusely reflective;

(e) said trouser construction including a riser, a pair of legs, and side pockets at the sides of said legs;

(f) trouser display panels adapted to be confined within said side pockets out of sight or extended outwardly from said side pockets for viewing, said trouser display panels being diffusely reflective; and (g) whereby, when all of said display panels are deployed outside of said breast pockets, said inverted pocket and said side pockets, the summation of said display panels are available for viewing substantially throughout a 360-degree periphery about said wearer.

32. A uniform for a human wearer, said uniform comprising matching shirt and trouser constructions:

(a) said shirt construction including a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke;

(d) shirt display panels detachably secured within said breast pockets and said inverted pocket by microcatch elements, said shirt display panels being adapted to be confined within said breast pockets and said inverted pocket out of sight or to be extended outwardly from said breast pockets and said inverted pocket for viewing;

(e) said trouser construction including a riser, a pair of legs, and side pockets at the sides of said legs;

(f) trouser display panels detachably secured within said side pockets by microcatch elements, said trouser display panels being adapted to be confined within said side pockets out of sight or extended outwardly from said side pockets for viewing; and (g) whereby, when all of said display panels are deployed outside of said breast pockets, said inverted pocket and said side pockets, the summation of said display panels are available for viewing substantially throughout a 360-degree periphery about said wearer.

33. A shirt construction for a human wearer, said shirt comprising:

(a) a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke; and (d) shirt display panels adapted to be confined within said breast pockets and said inverted pocket out of sight or to be extended outwardly from said breast pockets and said inverted pocket for viewing, said shirt display panels being retroreflective.

34. A shirt construction for a human wearer, said shirt comprising:

(a) a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke; and (d) shirt display panels adapted to be confined within said breast pockets and said inverted pocket out of sight or to be extended outwardly from said breast pockets and said inverted pocket for viewing, said shirt display panels being diffusely reflective.

35. A shirt construction for a human wearer, said shirt comprising:

(a) a back body section, right and left front body sections, pairs of arms and sleeves, a collar, and a yoke having selectively secured portions and selectively free portions, said yoke extending across the shoulders of said wearer from arm to arm and over said shoulders and about said collar between said back body section and said front body sections;

(b) said front body sections having breast pockets, said breast pockets having tops that are open and overlapped by said free portions of said yoke;

(c) an inverted pocket at said back body section, with a bottom opening defined between said back body section and a free portion of said yoke; and (d) shirt display panels detachably secured within said breast pockets and said inverted pocket by microcatch elements, said shirt display panels being adapted to be confined within said breast pockets and said inverted pocket out of sight or to be extended outwardly from said breast pockets and said inverted pocket for viewing.

* * * * *